United States Patent [19]

Pfundt

[11] Patent Number: 4,557,034

[45] Date of Patent: Dec. 10, 1985

[54] TOOL FOR MOUNTING CONNECTORS TO MULTI-CONDUCTOR CORDS OR WIRES

[75] Inventor: William N. Pfundt, Washington Crossing, Pa.

[73] Assignee: General Machine Products Company, Inc., Trevose, Pa.

[21] Appl. No.: 545,059

[22] Filed: Oct. 25, 1983

[51] Int. Cl.[4] ..... H01R 43/04

[52] U.S. Cl. ..... 29/566.4; 7/131; 29/33 M; 29/751; 81/423; 81/9.4

[58] Field of Search ..... 29/566.4, 750, 751, 29/748, 749, 33 M, 752, 753, 758, 566, 566.1, 566.3, 867; 7/130–134, 158, 163, 164; 81/423, 9.5 R, 9.5 B, 9.5 C, 9.51; 30/90.1

[56] References Cited

U.S. PATENT DOCUMENTS

| | | | |
|---|---|---|---|
| 2,784,621 | 3/1957 | Klingler | 7/133 X |
| 3,383,693 | 5/1968 | Vondrachek | 81/423 |
| 3,710,610 | 1/1973 | McCaughey | 29/751 X |
| 3,732,718 | 5/1973 | Barberio et al. | 29/751 X |
| 4,027,368 | 6/1977 | Asick | 29/751 |
| 4,292,833 | 10/1981 | Lapp | 81/423 X |
| 4,429,451 | 2/1984 | Angelico | 29/566.4 |
| 4,480,374 | 11/1981 | Meyer | 29/566.4 |

*Primary Examiner*—Z. R. Bilinsky
*Assistant Examiner*—Steven C. Bishop
*Attorney, Agent, or Firm*—Dann, Dorfman, Herrell and Skillman

[57] ABSTRACT

The tool includes a pair of handles which combine to form a hand grip for manipulation of the tool. When the handles are closed, a support element is displaced from its illustrated home position within the head portion, engages a connector and displaces it forwardly against a die to crimp the connector element to the multi-conductor wire positioned in the connector and effect electrical contact between individual contact elements in the connector and the conductors in the multi-conductor wire. The tool also provides for stripping the end of the wire to fit within the connector. Guide elements with upwardly open yokes on one handle accommodate the wire, and blade elements on the other handle provide a slicing action on opposite sides of the sheath of the wire as the blades engage the sheath as the handles are closed so that the sheath may be stripped to expose the conductors for insertion into the connector.

8 Claims, 9 Drawing Figures

FIG. 1
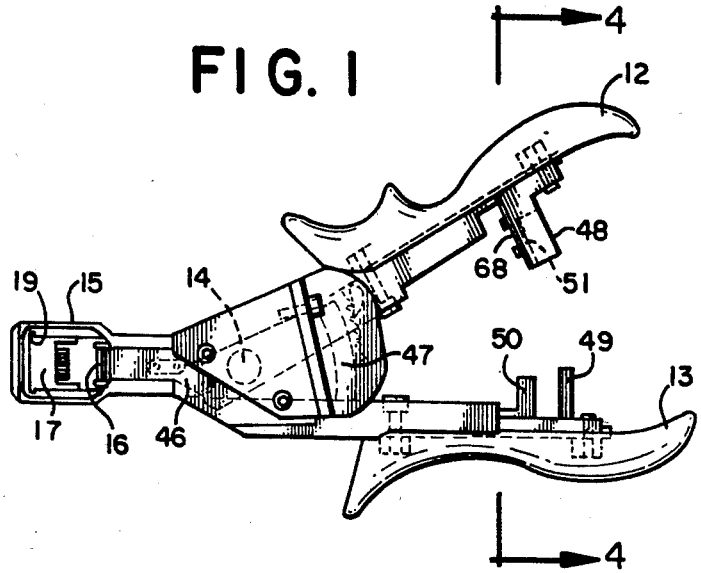
FIG. 2
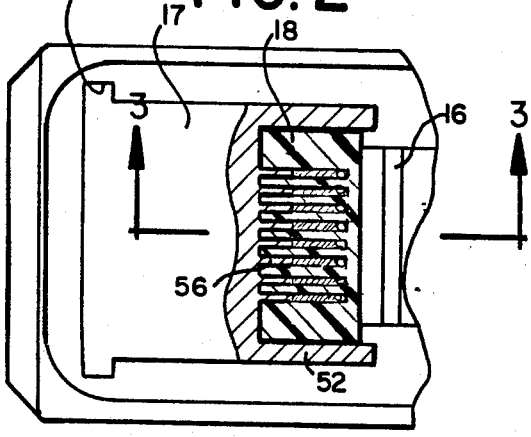
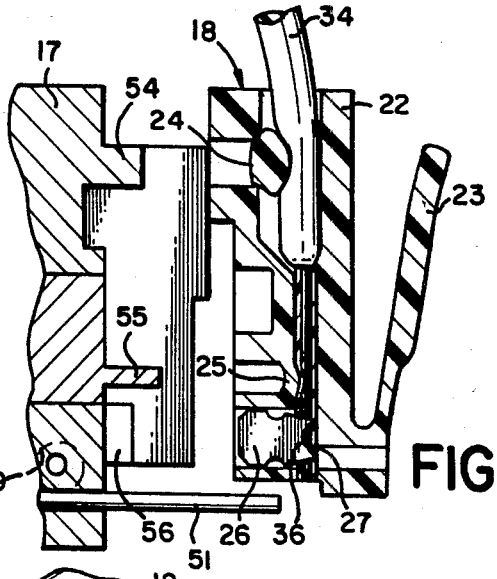
FIG. 3
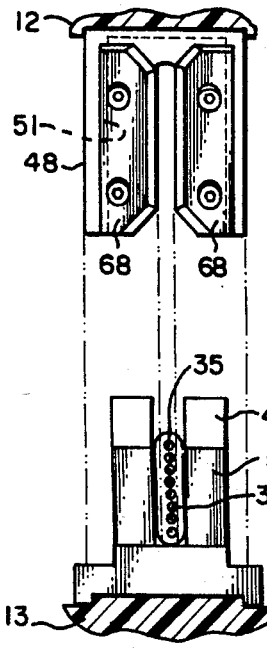
FIG. 4
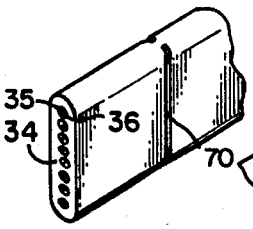
FIG. 6
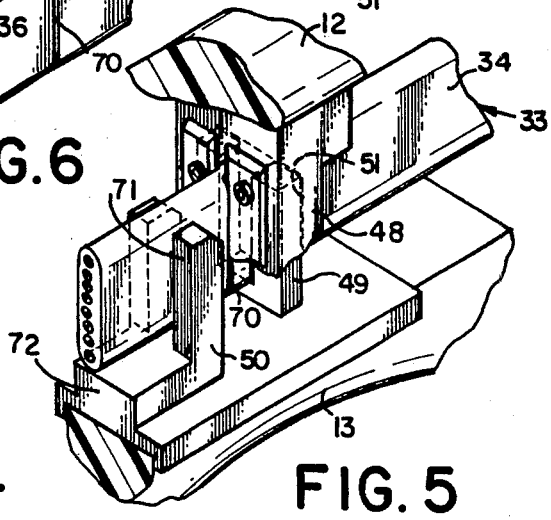
FIG. 5

TOOL FOR MOUNTING CONNECTORS TO MULTI-CONDUCTOR CORDS OR WIRES

FIELD OF THE INVENTION

The present invention relates to a hand tool for use in applying connectors to multi-conductor cords or wires, and has particular application to tools for use in the field in installing telephone and communication equipment using flat multi-conductor wires for interconnecting components of the system.

BACKGROUND OF THE INVENTION

Prior to the present invention, there has been no tool which is entirely satisfactory for use in the field for applying connectors to the ends of multi-conductor cords or wires, especially a tool which is capable of handling more than one type of connector and one type of wire. A particular tool, for example, may be suitable for use in applying a connector to the end of a four-conductor wire, but when it is necessary to use a six- or eight-conductor wire, a separate tool must be used. The prior art tools are complex and are subject to malfunction in the hands of an inexperienced operator.

SUMMARY OF THE INVENTION

With the foregoing in mind, the present invention provides a single hand tool assembly which is capable of applying the appropriate connector to any one of a number of multi-conductor wires through the simple replacement of a single die element.

The novel tool of the present invention incorporates an improved stripping mechanism which permits the multi-conductor wire to be stripped so as to expose the individual conductors and permit the proper application of the connector to the stripped end of the multi-conductor wire. The stripper mechanism is particularly adapted for use with flat wires in which the multiple conductors are disposed in a single central plane through the wire.

Another feature of the present invention resides in the configuration of the tool such that the die selected for a particular connector is effective to crimp the connector to the cover of the wire, and in addition, to crimp the connector to each individual strand of the multi-conductor wire, and also to insure proper interconnection of the connector contact elements with the respective conductors of the wire.

The tool of the present invention regulates the stroke of the crimping die to assure that the stroke is sufficient to impart the proper crimp to the connector to assure a mechanical interconnection between the connector and the wire and limits the stroke so that it does not over crimp or damage the connector or its components when it is applied to the wire.

BRIEF DESCRIPTION OF THE DRAWING

All of the features of the invention are more fully set forth hereinafter with reference to the accompanying drawing, wherein:

FIG. 1 is a side elevation of a tool embodying the present invention;

FIG. 2 is an enlarged view of the free end of the tool which performs the crimping operation with a portion of the die element broken away;

FIG. 3 is a fragmentary sectional view taken on the line 3—3 of FIG. 2;

FIG. 4 is a fragmentary sectional view taken on the line 4—4 of FIG. 1 showing the stripping mechanism for the conductor;

FIG. 5 is a perspective view of the structure of FIG. 4 with portions broken away to show the stripping operation in an intermediate phase;

FIG. 6 is a view showing the conductor in FIG. 5 separated from the stripping mechanism;

DESCRIPTION OF THE PREFERRED EMBODIMENT

Figure 7:
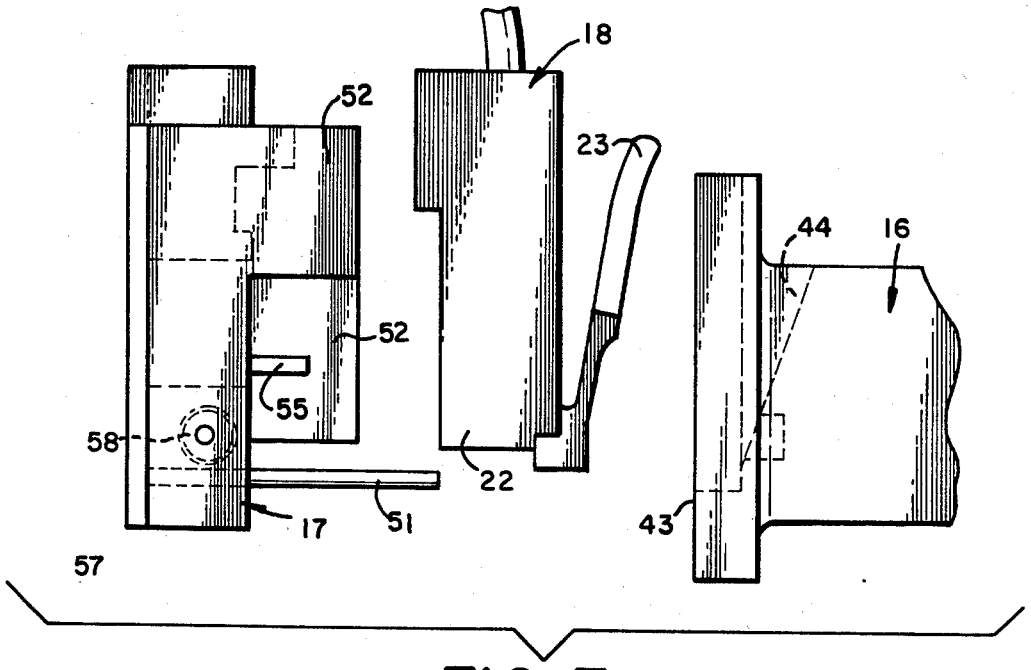
FIG. 7 is an exploded view showing the relationship between the die, the conductor, and the movable support of FIGS. 1–3.

The tool of the present invention is illustrated in FIG. 1 and includes a pair of handles 12 and 13 which combine to form a hand grip for manipulation of the tool. The handles, in the present instance, are pivotally connected as indicated at 14. One handle, preferably the lower handle, is rigidly connected to a head portion 15 and the other handle is connected by a linkage 46 to a movable support element 16 such that when the handles 12 and 13 are closed, the support element 16 is displaced forwardly in a stroke from its illustrated home position within the head portion 15. The head portion 15 has a guideway 19 adapted to receive a replaceable die 17 which is in position to receive a connector element 18 (see FIGS. 2 and 3) between the die 17 and the movable support 16. The movable support 16 engages the connector and displaces it forwardly against the die which is effective to crimp the connector element to the multi-conductor wire positioned in the connector and effect electrical contact between individual contact elements in the connector and the conductors in the multi-conductor wire. Suitable spring means is provided to open the handles upon completion of the stroke of the support element.

Figure 8:
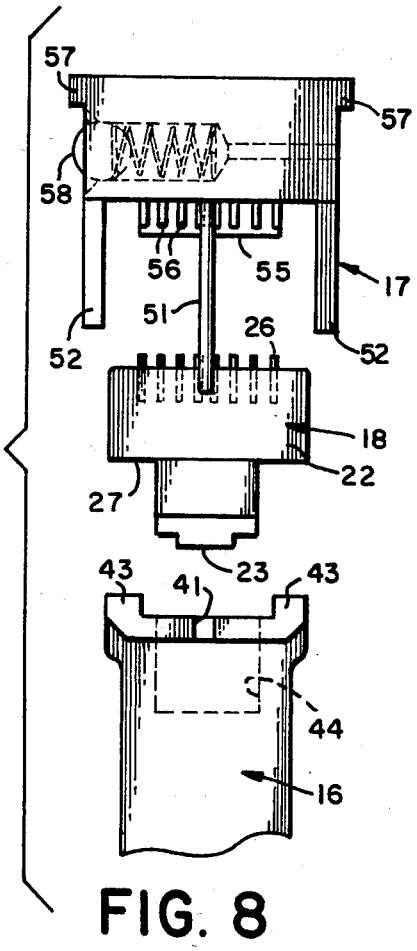
FIG. 8 is an elevational view as seen from the bottom in FIG. 7 showing the parts of FIG. 7.

As shown in FIG. 3, the connector 18 comprises a generally rectangular body 22 having a locking tang 23 for retaining the connector in its receptacle during use. The connector has a first deformable anchor part 24 for crimping against the outer sheath 34 of the multi-conductor wire 33, a second deformable anchor part 25 adapted to crimp to the individual covered conductors 35 of the wire and contact elements 26 slidable in the connector and having prongs 27 adapted to penetrate the covered conductors 35 of the wire and make electrical contact with the conductor 36 therein. As shown in FIG. 8, the tang 23 of the connector 18 is substantially narrower than the width of the body portion 22 and is located centrally along the undersurface as shown, providing exposed portions of the base as indicated at 27 which may engage the movable support 16. A centering pin 51 projects from the die 17 to engage in a receptacle 41 in the movable support 16 to insure that the connector 18 is properly seated between the side elements 52 of the die when the support 16 starts its stroke from the home position shown in FIG. 1.

As shown in FIGS. 7 and 8, the movable support 16 provides laterally spaced support shoulders 43,43 on which the base 27 may rest, and an angulated recess 44 is provided between the shoulders to accommodate the tang 23 of the connector. The support 16 is mounted in the head 15 for a longitudinal stroke upon closing of the handles 12 and 13, for example through the linkage 46 which connects the movable support 16 to the pivoted handle 12 for longitudinal displacement upon closing movement of the handles 12 and 13. A ratchet device is provided at 47 which provides for unilateral movement of the handle 12 relative to the handle 13 while the ratchet mechanism is engaged. This ratchet insures that the handle 12 completes its full closing stroke before the ratchet mechanism 47 disengages to permit the handle 12 to open again under the bias of the spring means (not shown). Thus, the ratchet mechanism 47 ensures at least a minimum leftward stroke of the movable support 16 when the handle closes.

The closing limit position of the handle is determined by a bifurcated upper stop member 48 mounted on the handle 12 to engage between spaced guide members 49 and 50, respectively, mounted on the lower handle 13. It should be noted that the stop member 48 has a recess 51 facing rearwardly to accommodate the guide member 49 when the handles are closed. Thus, when the handles are closed, the upper handle 12 swings downwardly on the pivot 14 and the rear guide member 49 fits into the recess 51 of the stop member 48 to limit the forward travel of the movable support 16 to a maximum stroke, preventing excess pressure being applied to the connector 18 between the movable support 16 and the die 17.

As indicated in FIG. 8, the forward stroke of the movable support 16 first presses the connector into the space between the side elements 52,52 of the die and thereafter causes the projecting multi-leaf plungers 56 of the die to displace the contact elements 26 into the body 22 so as to engage the prongs 27 with the wire conductors 36, as shown in FIG. 3. At the same time, the adjacent plunger 55 engages in the recess which accommodates the displaceable anchor part 25 of the connector and crimps the displaceable element against the individual covered conductors 35 of the wire 34. Likewise, the plunger 54 of the die 17 engages in the recess which accommodates the displaceable anchor part 24 of the connector to crimp that part against the sheath 34, as shown in FIG. 3. The cooperation of the ratchet mechanism 47, and the stop member 48 with the guide elements 49 and 50 assures effective crimping action without crushing the connector, thereby firmly crimping the connector 18 to the wire 33, and also crimping the connector to the individual covered strands 35, while making contact between the prongs 27 and the central conductors 36.

FIGS. 1–3 and 7–8 illustrate a connector for an eight-conductor wire, but the tool assembly has a plurality of dies adapted to accommodate not only the eight-conductor wire and connector but also four-conductor and six-conductor wires and connectors. Although the length and arrangement of parts is different in the different connectors, the width of the base 27 is uniform for all connectors, regardless of which multi-conductor wire the connector is designed to accommodate. Thus, the same movable support 16 is capable of use for any one of the various multi-conductor wire connectors used in the industry, and is effective to properly position the connector within the head for subsequent crimping operations.

Not only is the number of contact elements in the connector different, but the location and width of the first and second anchor parts 24 and 25 of the connector are different for each different wire for which the connector is designed. For example, in the four-conductor and six-conductor connectors, the deformable parts 24 and 25 are positioned closely together. Because of the differences in the configuration of the connectors for the various multi-conductor wires, separate die components are used for each connector. To this end, the head 15 of the tool is formed to replaceably mount separate die members to cooperate with the movable support 16. The projection of the parts 54, 55 and 56 is correlated to the minimum and maximum strokes of the support 16 to insure proper crimping of the connector parts to the wire 33.

The replaceable mounting of the die 17 in the head 15 is accomplished by the guideway 19 which receives outwardly projecting guide elements 57,57 of the die 17. The die 17 is positioned transversely of the head within the guideway 19 by a spring detent assembly 58 mounted in a bore 59 of the die 17. The assembly 58 cooperates with a detent in the head 15 to properly position the die within the head so that the plungers 54, 55 and 56 properly register with the components 24, 25 and 26 of the connector when the connector is properly seated in the movable support 16.

Figure 9:
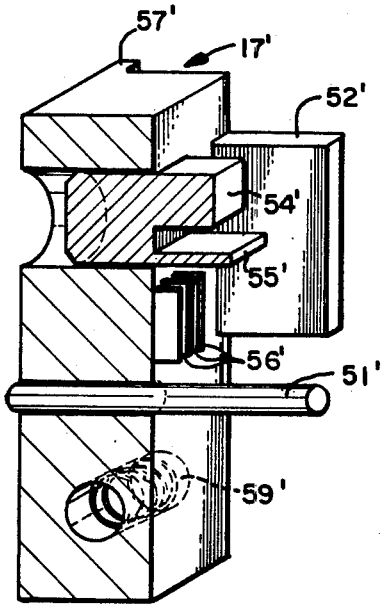
FIG. 9 is a sectional isometric view through a die used for crimping a six-conductor connector to a six-conductor wire.

As indicated above, the location and width of the anchor parts 24 and 25 are different in relation to the contact elements 26 in the various different connectors and to this end, a different die is provided to accommodate each connector. FIG. 9 illustrates a die 17' for a six-conductor connector and elements corresponding to those of the die 17 have been identified with corresponding primed reference numerals. The bore 59' accommodates a detent assembly similar to the assembly 58 which is adapted to cooperate with the same detent in the head 15 so as to position the die 17' in proper position relative to the support 16 so that the six-conductor connector is properly registered with the elements 54', 55' and 56'. It should be noted that when the die 17' is properly positioned in the guideway 19, the multi-leaf plunger 56' registers with the contact elements of the appropriate connector which is engaged on the support 16.

The tool of the present invention also provides a stripping mechanism for stripping the end of the wire 33 to fit within the connector 18. In order to engage the wire 33 with the connector 18, the outer sheath 34 of the wire 33 must be stripped to expose the covered conductors 35. The prongs 27 eliminate the necessity for stripping the covering from the individual conductor 36 in the covered conductor 35. The stripped outer sheath 34 exposes the individual covered conductors 35 so that they may be inserted into the connector to the extent shown in FIG. 3 wherein the sheathed portion 34 of the wire underlies the anchor portion 24 of the connector and the exposed covered conductors 35 underlie the anchor portion 25 of the connector. The free ends of the individual covered conductors 35 extend into the stalls provided between the partitions on opposite sides of the contact elements 26 at the closed end of the connector 18. It being noted that the partitions between the contact elements 26 assure that the covered conductor 35 is positioned in the path of movement of the contact element 26 as it is pressed by the presser elements 56 of the die.

The stripper mechanism of the present invention accommodates the flat wire for which the connector is designed. To this end, the elements 48, 49 and 50 function to facilitate stripping the free end of the wire 33. To this end, the guide elements 49 and 50, as shown in FIGS. 4 and 5, each provide an upwardly open yoke which accommodates the wire and holds it with the plane of its conductors 36 generally vertical as shown in FIGS. 4 and 5. The upwardly-directed slots or openings of the guide members or yokes 49 and 50 snugly engage the wire so as to firmly position it in the upright position shown with the coplanar conductors of the wire positioned along the centerline of the slot. The stop element 48 is likewise bifurcated as shown in FIG. 4 and has blade elements 68,68 mounted along opposite edges of the opening with a clearance between the blade edges which is slightly greater than the thickness of the covered conductors 35 within the sheath 36. The opposite end of the blade edges of the blades 68 are angulated and sharpened as shown to provide a slicing action as the blades engage the sheath 34 of the wire 35 as indicated by the broken lines in FIG. 4.

As shown in FIG. 5, the wire is firmly engaged within the yokes 49 and 50 and as the stop member 48 swings down about the pivot 14, the angular leading edges of the blade elements 68,68 slice the outer sheath 34 of the wire 33 as it is held between the yokes 49 and 50. The engagement of the rear yoke 49 into the recess 51 assures proper lateral positioning of the blades 68 so that they do not sever the conductors 35 but confine the slicing to the sides of the sheath, as shown at 70 in FIG. 6. When the wire 33 is withdrawn axially toward the rear, the blades serve to strip the sheath from the conductors 35 forwardly of the slice shown at 70. The axial withdrawal of the wire 33 breaks the sheath at the top and bottom of the sheath between the opposed slices 70,70 so as to assure the desired stripping action, leaving the covered conductors 35 exposed at the forward end of the wire. The free end of the wire may then be inserted into the connector as shown in FIG. 3 with the stripped conductors 35 underlying the anchor portion 25 and the contact elements 26 of the connector.

The guide member or yoke 50 also serves as an index to gauge the length of the stripped end of the wire. For four- and six-conductor connectors, the free end of the wire 33 is positioned flush with the upstanding indexing surface 71 of the yoke member. For eight-conductor connectors, the free end of the wire is positioned flush with the forward indexing surface 72 of the guide 50. In this fashion, the stripped conductors are of a proper length to engage in the contact-element-receiving stalls of the connector.

The stripper of the present invention is particularly effective in connection with the flat multi-conductor wires with which the present invention is used, since the slicing action of the blades 68,68 as they pass downwardly between the yokes 49 and 50 slices the plastic sheath of the wire and facilitates the separation of the end portion of the sheath from the wire by the axial displacement from the stripping blades, the slicing action being particularly effective with the plastic composition of which the sheath is made. Although not shown in the drawing the handle 13 incorporates indexing means to guage the spacing of the free end of the unstripped wire 33 from the path of the knives 68, so that the stripping operation provides stripped ends of the conductors 35 of the proper length to engage in the stalls between the partitions of the connector which receives the wire.

The present invention therefore provides a unitary tool which is effective to crimp a connector to a flat multi-conductor wire, whether the wire is four-conductor, six-conductor or eight-conductor. The only adjustment required is that the proper die be snapped into place in the head to accommodate the particular connector used with the wire. The stripper assembly between the handles is effective regardless of the width of the wire since in the course of the slicing action the blades pass across the full width of the wire and do not rely on a pinching engagement, as is the case with standard wire strippers.

While a particular embodiment of the present invention has been herein illustrated and described, it is not intended to limit the invention to such disclosure, but changes and modifications may be made therein and thereto within the scope of the following claims.

I claim:

1. A hand tool assembly for applying a selected connector to a given flat multi-conductor wire comprising a sheath and a plurality of co-planar conductors, said selected connector adapted to accommodate said given wire and having a number of stalls corresponding to the number of conductors in said wire, contact elements displaceably mounted in said stalls adapted to penetrate the conductors of said multi-conductor wire, and two anchor parts operable to be displaced in said connector to crimp respectively against said sheath and said conductors, said tool comprising a pair of handles and a head having a transverse guideway and a movable support operable to be longitudinally displaced in a stroke from a home position toward said guideway upon closing movement of said handles and away from said guideway to said home position upon opening movement of said handles, said tool having ratchet means limiting movement of said handles to insure a minimum closing stroke of said movable support, and stop means comprising a stop member on one of said handles and a yoke member on the other of said members mating with the stop means upon closing movement of said handles to define a maximum closing stroke, a die slidably mounted in said guideway and means to releasably position said die in said guideway laterally of said head, said guideway positioning said die spaced from the home position of said support to receive said selected connector therebetween, said die being dimensioned to cooperate with said selected connector, having a multi-leaf plunger registering with the contact elements of said connector when positioned in said guideway and being operable when said handles close to displace the contact elements into contact with said conductors upon completion of said minimum closing stroke, and additional plunger means registering with said anchor parts to crimp said parts to said sheath and said connectors upon completion of said minimum stroke; said tool including wire stripper means between said handles for stripping the sheath from said conductors at the free end of the wire to permit penetration of said conductors into said stalls, said stripper means including an elongated slot means in said yoke member to receive said wire and position said coplaner conductors along the centerline of said slot means, said yoke means comprising a pair of guide members spaced-apart longitudinally of said wire, and slicing means on said stop member having a pair of blade edges adapted to engage said sheath between said guide members to move generally parallel to said centerline of the slot means to slice into the sheath of the wire along opposite sides of said conductors, so that upon axial withdrawal of said wire from said blade edges, the sheath is stripped from the conductors.

2. A hand tool assembly according to claim 1 which is adapted to apply one of a plurality of different connectors to a wire adapted to fit with said one connector, said assembly including a separate die for each different connector, and register means to position the connector so that contact elements of the connector are in registry with the multi-leaf plunger when the die for said connector engages said connector.

3. A hand tool assembly according to claim 2 wherein said head has a detent adjacent said guideway, and each of said separate dies has a spring detent assembly cooperable with said detent to comprise said releasable positioning means.

4. A hand tool assembly according to claim 2 wherein each of said separate dies has outwardly projecting guide portions slidable in said guideway, and side portions and centering pin means projecting longitudinally of said head toward said movable support to receive therebetween the connector for said die to comprise said register means.

5. A hand tool for use with a flat multi-conductor wire comprising a sheath and a plurality of co-planar conductors, comprising a pair of handles and wire stripper means for stripping the sheath from said conductors at the free end of the wire, said stripper means including upstanding yoke means carried by one of said handles comprising a pair of guide members spaced-apart longitudinally of said wire and having slot means with coplanar centerlines to receive said wire and position said coplanar conductors along the coplanar centerlines of said slot means, and slicing means actuated by the other of said handles comprising an element displaceable between said guide members and having a pair of blade edges adapted to move generally parallel to and on opposite sides of the plane of said centerlines to slice into the sheath of the wire along opposite sides of said conductors between said guide members, so that upon axial withdrawal of said wire from said blade edges, the sheath is stripped from the conductors at the free end of the wire.

6. A tool according to claim 5 wherein the leading edges of said blade edges are beveled to facilitate the slicing operation.

7. A tool according to claim 5 wherein one of said guide members has a pair of separate indexing surfaces spaced from the path of movement of said blade edges and adapted to recieve the free end of the wire to gauge the length of the sheath stripped from the wire.

8. A method of stripping the sheath from the terminal end portion of a flat multiconductor wire having a sheath and a plurality of coplanar conductors disposed along the center plane of the flat wire by particularly severing the sheath at a selected point spaced from the free terminal end of the wire and holding the terminal end portion of the sheath beyond said selected point while withdrawing the wire, thereby withdrawing the conductors from within the severed terminal end portion of the sheath, said method comprising the steps of providing a pair of supports having elongated slots with parallel centerlines, positioning said multiconductor wire on its edge between said supports with its center plane coincident with the centerlines of said slots and with the selected point positioned between said supports, providing a pair of knives having parallel knife edges spaced apart a distance greater than the thickness of the conductors in the central plane and less than the thickness of the multiconductor wire including the sheath, displacing said blades parallel to said central plane and across the width of said multiconductor wire at said selected point between said supports so that the blade edges partially sever the sheath without severing the conductors, maintaining said blades in position between said supports while withdrawing said multiconductor wire axially from said supports whereby said blades retain the terminal end portion of the sheath to effect separation of the sheath portion from the conductor along the length of the wire between said selected point and its free terminal end.

* * * * *

UNITED STATES PATENT AND TRADEMARK OFFICE

CERTIFICATE OF CORRECTION

PATENT NO. : 4,557,034

DATED : December 10, 1985

INVENTOR(S) : William N. Pfundt

It is certified that error appears in the above—identified patent and that said Letters Patent is hereby corrected as shown below:

Column 2, line 10, delete "conductor" and insert --connector--.
Claim 8, line 4, delete "particularly" and insert --partially--.

Signed and Sealed this

*First* Day of *April 1986*

[SEAL]

*Attest:*

DONALD J. QUIGG

*Attesting Officer*

*Commissioner of Patents and Trademarks*